US005197686A

United States Patent [19]

Okada et al.

[11] Patent Number: 5,197,686

[45] Date of Patent: Mar. 30, 1993

[54] SPOOL STORAGE RACK WITH REMOVABLE SUPPORTING PARTITIONS

[75] Inventors: Yozo Okada, Toyama; Akiyoshi Kando, Uozu; Kazuki Kuse, Toyama, all of Japan

[73] Assignee: Yoshida Kogyo K. K., Tokyo, Japan

[21] Appl. No.: 559,070

[22] Filed: Jul. 30, 1990

[30] Foreign Application Priority Data

Aug. 4, 1989 [JP] Japan ..... 1-92392[U]

[51] Int. Cl.[5] ..... B65H 16/02

[52] U.S. Cl. ..... 242/55.3; 312/216

[58] Field of Search ..... 242/58, 55.3; 206/44.12, 45.11, 391, 394, 389; 312/12, 119, 216; 211/4

[56] References Cited

U.S. PATENT DOCUMENTS

| | | | |
|---|---|---|---|
| 924,225 | 6/1909 | Feely | 312/216 |
| 1,486,242 | 3/1924 | Greene | 312/216 |
| 2,181,808 | 11/1939 | Goldsmith | 206/77 |
| 3,404,929 | 10/1968 | Wright et al. | 312/216 |
| 3,482,684 | 12/1969 | Schladale | 242/68.5 |
| 4,570,794 | 2/1986 | Capitao, Jr. | 206/394 |
| 4,929,861 | 5/1990 | Metcalf | 312/216 |

FOREIGN PATENT DOCUMENTS

| | | | |
|---|---|---|---|
| 1660955 | 6/1967 | Fed. Rep. of Germany . | |
| 2007282 | 9/1971 | Fed. Rep. of Germany . | |
| 1307988 | 9/1961 | France | 242/55.3 |
| 6900474 | 7/1969 | Netherlands . | |
| 13026 | of 1894 | United Kingdom | 242/55.3 |
| 330135 | 6/1930 | United Kingdom . | |
| 396689 | 7/1933 | United Kingdom | 206/394 |
| 1328192 | 8/1973 | United Kingdom | 312/216 |
| 2037157 | 12/1978 | United Kingdom | 312/216 |
| 2137164 | 10/1984 | United Kingdom | 242/55.3 |

*Primary Examiner*—Katherine Matecki
*Assistant Examiner*—John Rollins
*Attorney, Agent, or Firm*—Hill, Steadman & Simpson

[57] ABSTRACT

A rack for storing a plurality of spools with elongated strips wound therearound comprises a box-like frame including a pair of parallel spaced plates; a plurality of partitions, each of which has on one of its surfaces a support axle for rotatably and releasably holding the spool; and means for releasably fastening the partitions in a parallel spaced relation to each other between the plates.

The rack further includes elongated lock plates which have slots and notches formed in and arranged at uniform intervals longitudinally of the elongated lock plates. The lock plates are attached to the rack by pins protruding through the slots for slidably holding the lock plate to a front surface of the rack.

4 Claims, 2 Drawing Sheets

SPOOL STORAGE RACK WITH REMOVABLE SUPPORTING PARTITIONS

BACKGROUND OF THE INVENTION

1. Field of the Invention

The present invention generally relates to a rack for holding articles and more particularly to a rack used for storing a plurality of spools in juxtaposed relation to each other around which are spooled a plurality of elongated fabric strips of different colors, such as slide fastener chains, or ribbons, in which rack the elongated fabric strips of any desired color can be unwound easily out of the corresponding spools.

2. Description of the Prior Art

It has been common heretofore for a plurality of spools with elongated strips wound therearound to be rotatably mounted on a common axle in juxtaposed relation, with adjacent spools touching each other on their respective sides. Consequently, as a desired elongated strip is being drawn and unwound out of the spool, the thus caused rotation of the spool is transmitted to adjacent spools, so that undesired strips are unintentionally unwound out of the adjacent spools. To make the matter worse, the thus unintentionally unwound part of the undesired strip is likely to get entangled with the strip which is being drawn intentionally out of the selected spool.

Furthermore, when it is desired to replace a vacated spool on the elongated common axle; if the vacated spool does not happen to be located on or adjacent to either of the opposed extreme ends, then it is not very easy to remove; so, if it is located at or adjacent to the midpoint the elongated axle, the replacement of the vacated spool would entail temporary removal of many spools which need not be replaced, which makes replacement of spools very tedious and time-consuming.

SUMMARY OF THE INVENTION

With the foregoing drawbacks in view, it is an object of this invention to provide a rack for storing a plurality of spools with elongated strips wound therearound which is entirely free from the disadvantages encountered by conventional racks.

It is another object of this invention to provide a rack of the type described in which a desired elongated strip can be unwound from a desired spool without interfering with any other spools.

It is still another object of this invention to provide a rack of the type described in which any vacated spool can be replaced very easily and swiftly, in whatever part of the rack it may be positioned.

According to the present invention, there is provided a rack for storing a plurality of spools with elongated strips wound therearound, the rack comprising a box-like frame including a pair of parallel spaced plates; a plurality of partitions, each of which has on one of its surfaces a support axle for rotatably and releasably holding the spool; and means for releasably fastening the partitions in a parallel spaced relation to each other between the plates.

The above and other objects, features and advantages of the present invention will become apparent to those skilled in the art from the following detailed description made with reference to the accompanying drawings in which preferred structural embodiments incorporating the principles of the present invention are shown by way of example only.

DETAILED DESCRIPTION

Figure 1:
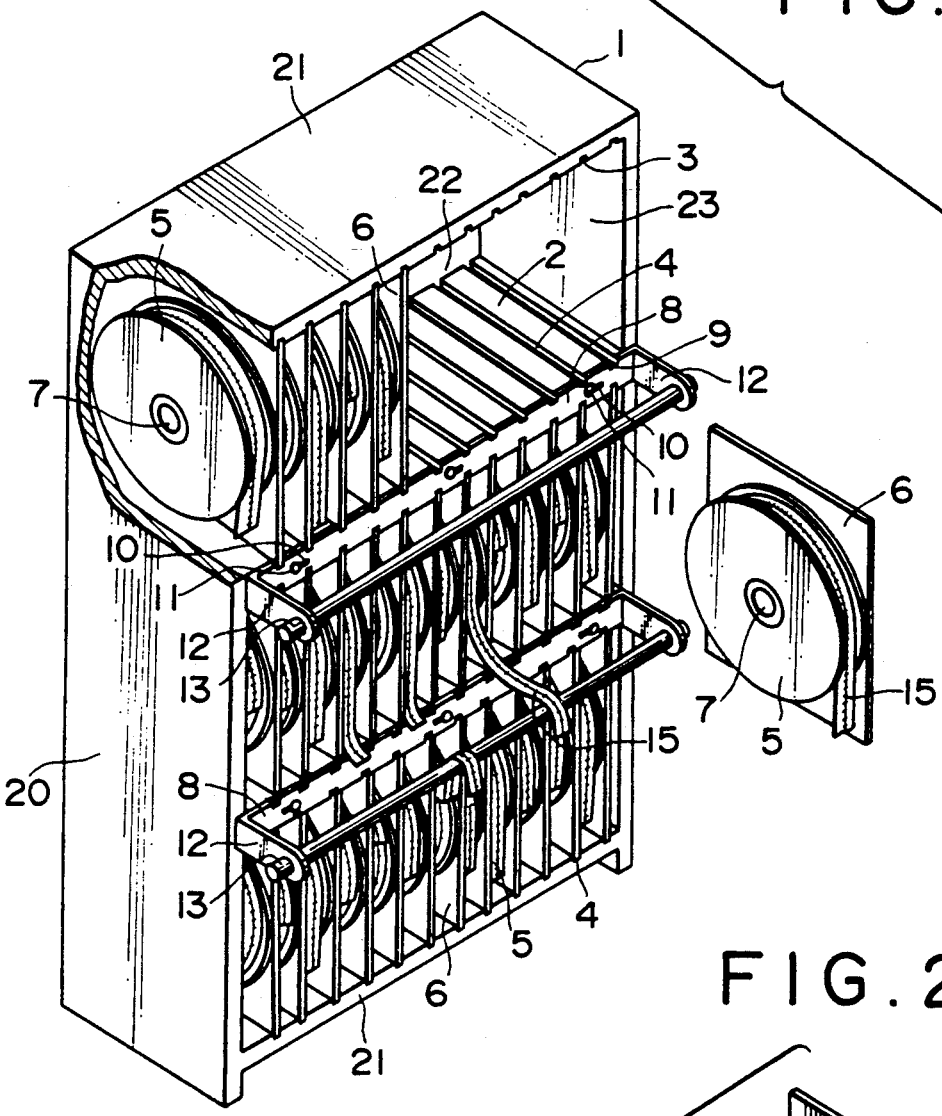
FIG. 1 is a partly-broken-away exploded perspective view of a rack according to the present invention.

FIG. 1 shows a rack comprising a box-like frame 1 in which three rows of spools 5 loaded with slide fastener chains 15 are disposed in vertical alignment. The box-like frame 1 comprises a pair of side boards 20, 20 standing vertically, a pair of parallel spaced end plates 21, 21 joined at their respective ends with the corresponding ends of the sides boards 20, 20 and a back board 22 joined with the rear side edges of the side boards 20, 20 and the end plates 21, 21, so that the box-like frame 1 is only open in a forward direction. The box-like frame 1 further includes a plurality of parallel spaced intermediate plates 2 between the ends plates 21, 21 to thus provide a plurality of chambers 23 in the frame 1. In each chamber 23, two confronting series of grooves 3, 4 are formed in the opposed surfaces of the adjacent plates 2, 21. The two confronting series of grooves 3, 4 are arranged in registry with each other, so that a plurality of partitions 6 with the spools 5 wound therearound can fit between the opposed plates 2, 21 with the opposite edges of the former slid along the opposed mating grooves 3, 4 of the latter. Each adjacent grooves 3, 4 are so spaced from each other that the partitions 6, 6 fitted therein are spaced from each other at an interval slightly greater than the width of the spool 5.

Figure 2:
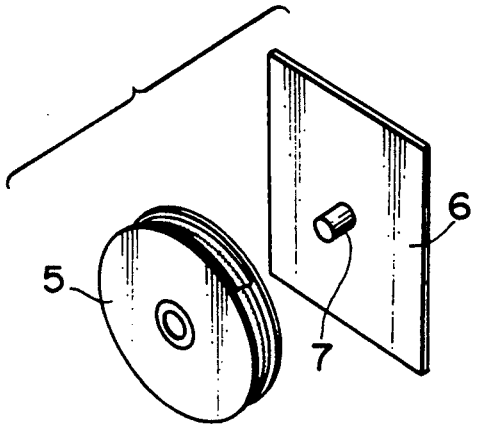
FIG. 2 is a perspective view of a spool and its corresponding partition as detached from each other.

As better shown in FIG. 2, each of the partitions 6 is in the form of a substantially square plate and has an upright support axle 7 on one of its sides at its center. On the support axle 7, there is rotatably mounted a spool 5, around which a slide fastener chain 15 is wound. These spool-loaded partitions 6 have their opposite edges slidably fitted in the confronting mating grooves 3, 4 in the opposed surfaces of the adjacent plates 2, 21, with their support axles 7 directed in the same direction.

Figure 4:
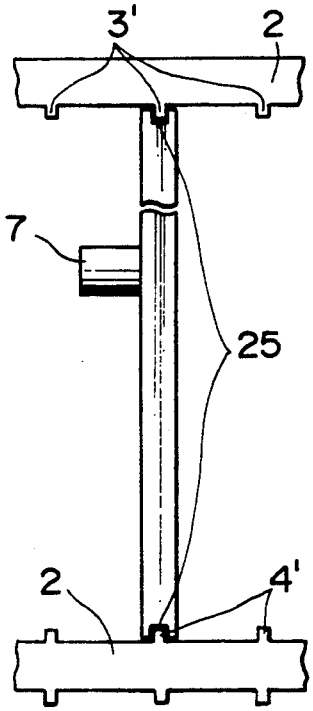
FIG. 4 is fragmentary front elevatioinal view of a rack according to a modified embodiment of the present invention, with a lock plate detached from the intermediate plate.

Although FIG. 1 shows the pair of confronting series of grooves 3, 4 formed in the plates 2, 21 serving as means for releasably fastening the partitions 6 in the box-like frame 1, a pair of confronting series of ridges 3', 4' may be provided on the opposed sides of the plates 2, 21 to serve the same purpose, as shown in FIG. 4. In this event, the partition 6 must have in each of its opposite edges a groove 25 adapted for sliding engagement with the ridges 4' on the plates 2, 21. Each adjacent ridges 3', 4' are so spaced from each other that the partitions 6, 6 fitted thereon are spaced from each other at an interval slightly greater than the width of the spool 5.

The rack further includes a plurality of elongated lock plates 8 which have a plurality of slots 10 formed in and arranged at uniform intervals longitudinally of the elongated lock plate 8. The same number of pins 11 as there are slots 10 are protuberantly provided at the same intervals on the front side of each intermediate plate 2. The elongated lock plate 8 is mounted slidably on and along the front side of each of the intermediate plates 2 with the elongated slots 10 of the former fittingly engaged with the protuberant pins 11 of the latter. The lock plate 8 further has a pair of series of notches 9, one in each side edge, which notches 9 are arranged at the same intervals as the grooves 3, 4. Each of the notches 9 is as great as or slightly greater than each of the grooves 3, 4. The elongated lock plate 8 is slidable on the front side of the intermediate plate 2 between the first position in which the notches 9, 9 of the former comes into registry with the grooves 3, 4 of the latter and the second position in which the notches 9, 9 comes out of registry with the grooves 3, 4. It is readily acknowledged that in the first position, the elongated lock plate 8 allows the spool-loaded partitions to come out of the chamber 23, while in the second position, the elongated lock plate 8 prevents the spool-loaded partitions from escaping off the chamber 23. A pair of brackets 12, 12 are provided on opposite ends of the elongated lock plate 8 so as to project forwards therefrom. Joined to the brackets 12, 12 is a round pole 13, which serves as a handle with which an operator can reciprocate the lock plate 8 and also serves as a guide bar on which the unwound part of the slide fastener chain 15 drapes via its own gravity.

Although the frame 1 is shown to contain a plurality of chambers 23 in FIG. 1, it may contain only a single chamber 23. Furthermore, although the frame 1 is so constructed as to hold the partitions 6 vertically thereon, the frame 1 may hold them either horizontally or at an angle.

Figure 3:
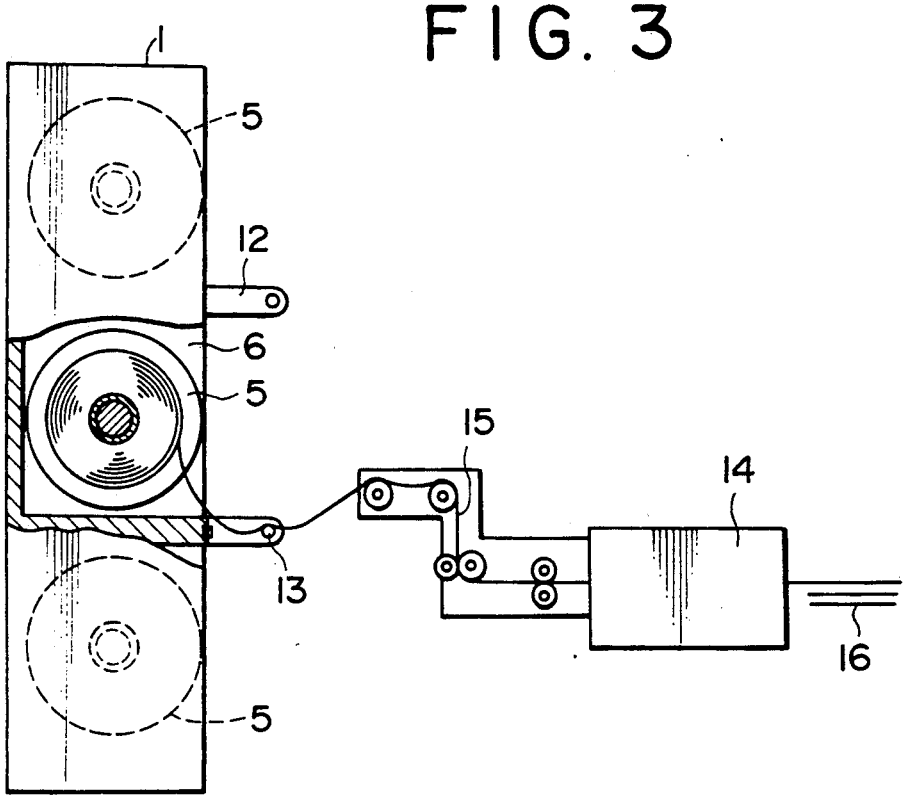
FIG. 3 is diagramatical view of an apparatus for processing a slide fastener chain, used with the rack according to the present invention.

FIG. 3 shows the way in which the slide fastener chain 15 is unwound from the desired spool 5 on the frame 1 and fed to a slide fastener finishing machine 14. Many spools 5 having slide fastener chains 15 of various types or colors wound therearound are housed neatly in the frame 1 in the manner set forth hereinabove. A slide fastener chain 15 can be unwound from any desired spool 5. If change of colors is required, one can select any color desired. When a certain spool 5 has been vacated, one can replace the vacated spool 5 by simply sliding the partition 6 out of the chamber 23.

With the construction of the rack according to the present invention set forth hereinabove, each elongated strip such as a slide fastener chain can be unwound from the desired spool safely without interfering with adjacent spools.

Furthermore, since spool-loaded partitions are independently stored in their respective grooves, any vacated spool can be replaced very easily and swiftly.

Obviously, many modifications and variations of the present invention are possible in light of the above teachings. It is therefore to be understood that within the scope of the appended claims, the invention may be practiced otherwise than as specifically described.

What is claimed is:

1. A rack for storing a plurality of spools with elongated strips wound therearound, the rack comprising:

a box-like frame including a pair of parallel spaced plates;

a plurality of partitions having lateral edges, each of which has on one of its surfaces a support axle for rotatably and releasably holding a spool; and means for releasably fastening the partitions in a parallel spaced relation to each other between the plates;

the means for releasably fastening comprising a first series of grooves in a first plate of said parallel spaced apart plates and a second series of grooves in a second plate of said parallel spaced apart plates, the grooves of said first series arranged and spaced apart to align in facing relationship with the grooves of said second series forming a plurality of corresponding groove pairs across the distance between said parallel plates, the corresponding lateral edges of each partition slidably engageable with one groove pair; and an elongated rectangular lock plate having a plurality of slots formed in and arranged at uniform intervals longitudinally of the lock plate and a series of notches formed in and along a side edge thereof so as to be arranged at the same spacing as the first series of grooves, the lock plate being mounted slidably on and along the front side of the first plate, the first plate providing a pin means protruding outward into each slot for slidably mounting the lock plate to the first plate, so that the lock plate is slidable between the first position in which the notches come into registry with the grooves and the second position in which the notches come out of registry with the grooves.

2. The rack according to claim 1 further comprising a pair of horizontally disposed brackets mounted to said lock plate and a horizontally disposed rod connected between the brackets and extending across a width of said frame.

3. A rack for storing a plurality of spools with elongated strips wound therearound, the rack comprising:

a box-like frame including a pair of parallel spaced plates;

a plurality of partitions having lateral edges, each of which has on one of its surfaces a support axle for rotatably and releasably holding a spool; and means for releasably fastening the partitions in a parallel spaced relation to each other between the plates;

the means for releasably fastening comprising a first series of ridges in a first plate of said parallel spaced apart plates and a second series of ridges in a second plate of said parallel spaced apart plates, the ridges of said first series arranged and spaced apart to align in facing relationship with the ridges of said second series forming a plurality of corresponding ridge pairs across the distance between said parallel plates, each partition having grooves in and along its lateral edges and having its grooves come into slidable engagement with one ridge pair; and an elongated rectangular lock plate having a plurality of slots formed in and arranged at uniform intervals longitudinally of the lock plate and a series of notches formed in and along a side edge thereof so as to be arranged at the same intervals as the first series of ridges, the lock plate being mounted slidably on and along the front side of the first plate, the first plate providing a pin means protruding outward into each slot for slidably mounting the lock plate to the first plate, so that the lock plate is slidable between the first position in which the notches come into registry with the ridges and the second position in which the notches comes out of registry with the ridges.

4. The rack according to claim 3 further comprising a pair of horizontally disposed brackets mounted to said lock plate and a horizontally disposed rod connected between the brackets and extending across a width of said frame.

* * * * *